US005272967A

United States Patent [19]

Held

[11] Patent Number: 5,272,967

[45] Date of Patent: Dec. 28, 1993

[54] CONTINUOUSLY OPERATING DOUBLE BAND PRESS AND HEAT CONDUCTING ELEMENT THEREFOR

[76] Inventor: Kurt Held, Alte Strasse 1, D-7218 Trossingen Schura, Fed. Rep. of Germany

[21] Appl. No.: 819,117

[22] Filed: Jan. 10, 1992

[51] Int. Cl.[5] ..... B30B 5/06; B30B 15/34

[52] U.S. Cl. ..... 100/93 P; 100/93 RP; 100/151; 156/583.5; 425/371; 425/407; 165/185

[58] Field of Search ..... 100/93 P, 93 RP, 151; 156/583.1, 583.5; 425/371, 407; 165/80.3, 86, 185

[56] References Cited

U.S. PATENT DOCUMENTS

| | | | |
|---|---|---|---|
| 3,980,016 | 9/1976 | Taylor | 100/93 P X |
| 4,080,241 | 3/1978 | Grevich | 100/93 P X |
| 4,541,889 | 9/1985 | Held | 100/93 RP X |
| 4,770,242 | 9/1988 | Daikoku et al. | 165/185 |
| 4,802,837 | 2/1989 | Held | 425/371 X |

FOREIGN PATENT DOCUMENTS

| | | | |
|---|---|---|---|
| 0405184 | 1/1991 | European Pat. Off. | 100/93 P |
| 2421296 | 11/1975 | Fed. Rep. of Germany . | |
| 3325578 | 1/1985 | Fed. Rep. of Germany . | |
| 3719976 | 6/1987 | Fed. Rep. of Germany . | |

*Primary Examiner*—Stephen F. Gerrity
*Attorney, Agent, or Firm*—Klaus J. Bach

[57] ABSTRACT

A continuously operating double band press for fabrication of laminates , chip- or fiberboard, plywood or the like has an upper endless press band and a lower endless press band wound over respectively two reversing drums rotatably supported in a rigid press stand. Pressure chambers are arranged at the inner sides of the press bands, which are bounded in vertical direction by pressure plates fastened in the press stand and the press bands and in horizontal direction by floating seals. A pressure produced by fluid agents acts in the pressure chambers. Elements are arranged in the pressure chambers provided with a body and projecting individual surface enlargement members. The projecting individual the surface enlargement members consist of a material having good thermal conductivity and protrude into the fluid pressure agent located in the pressure chamber and have a good thermal conducting contact with the body of the element.

19 Claims, 6 Drawing Sheets

CONTINUOUSLY OPERATING DOUBLE BAND PRESS AND HEAT CONDUCTING ELEMENT THEREFOR

FIELD OF THE INVENTION

The invention relates to a continuously-operating double band press for fabrication of laminates, chip- and fiberboard, plywood and the like which press includes two endless press bands wound respectively, over two reversing drums rotatably supported in a rigid press stand, and the inner sides of which at least partially defined pressure chambers bounded in a vertical direction by pressure plates, and slides, in contact engagement, along elastically pressed elements formed of a material with good thermal conductivity and located in the pressure chambers.

BACKGROUND OF THE INVENTION

Double band presses (see also the DE-OS 24 21 296) serve for continuous fabrication of endless web-shaped pressed or molded products or commodities, especially for fabrication of decorative layered laminates, copper-lined electrolaminates, thermoplastic webs, chipboards, fiberboards and the like. These double band presses have two endlessly revolving press bands, between which the webs of a product to be pressed are cured or hardened under the influence of pressure and possibly, also heat while simultaneous being conveyed in the feed direction. Some pressed or molded product webs require also cooling under pressure performed after the application of heat for a complete hardening. To generate the pressure acting upon the web of the product to be pressed, these so-called isobaric presses have pressure chambers, which are bounded by pressure plates and press bands in the vertical direction and on the sides by floating seals. The pressure in the pressure chamber is built up by fluid pressure agents, such as oil or compressed air.

It is known for supplying heat to the product to be molded, to heat the reversing drums located on the inlet side of the double band press. Thereby the press bands of the double band press are heated by the heated reversing drums. The press bands then convey the absorbed quantity of heat into the region in which the commodity to be pressed and lying between the two press bands is subjected to area pressure, into the so-called reaction zone and there transfer the heat to the molding commodity. Because of the limited thermal capacity of the press bands, this quantity of heat however is insufficient.

For the supply of heat into the reaction zone furthermore, the pressure plate can be heatable to serve as heating plates or, for removal of heat, they can be cooled to serve as cooling plates. Because of the bad thermal conductivity of the fluid pressure agents or media; however, only very little heat can be given off to the press band through the fluid pressure agent from the heating plates or can be removed from the press band to the cooling plates. Furthermore, it is possible to heat or cool the fluid pressure agent itself. However because of the relatively low press band velocity, the quantity of heat transmitted by convective heat transmission from the fluid pressure agent to the press band is small and is practically of no significance.

A method and an apparatus have become known from the DE-OS 37 19 976, whose object it is to improve the convective heat transmission from the pressure agent to the press band. This is achieved by fans arranged in the pressure chamber and causing forced circulation of the pressure agent, so that a turbulent flow results. It has however been seen, that this method also does not permit in many cases to transmit sufficient heat to the press band in the reaction zone, since the heat transmittal surface proper is constituted by the press band surface located within the pressure chamber and the pressure chamber is not permitted to exceed certain maximum lengths because of economic and technical considerations.

Another possibility for transmitting additional heat to the press bands in the region of the reaction zone has become known from the DE-OS 33 25 578. There thermally convection elements are shown, which consist of a material with good thermal conductivity and are arranged with a surface providing a good thermal conduction contact to the pressure plate in the double band press. The other surface of the thermally conducting elements contacts the inner sides of the press band in the region of the reaction zone, so that the press band glides along this surface during operation of the double band press. The pressure plates are warmed to a higher temperature than the nominal temperature in the reaction zone, so that a thermal gradient is formed between the pressure plate and the press band and heat flow is directed from the pressure plates to the press band through the thermally conducting elements. This additional heat is then transferred from the press band to the product to be pressed or molded. Such an arrangement permits also cooling of the press band by cooling the pressure plate. It can however be disadvantageous also here, that an increased thermal resistance arises because of the relatively long travel from the pressure plate to the reaction zone, so that in some application cases still insufficient heat can be transmitted with such an arrangement.

SUMMARY OF THE INVENTION

The main object of the invention is to further refine heat transmitting elements used in the double band press of the previously described type in such a way, that the heated fluid pressure agent located in the pressure chamber can supply a greater quantity of heat to the press band or can convey same from the press band onto the cooled fluid pressure agent.

The object of the invention is achieved by providing elements of a material with good thermal conductivity having a body and projecting individual surface enlargements which have a good thermal contact with the body and protrude into the fluid pressure agent.

The advantages achievable by the invention consist especially in that the heat exchange between the fluid pressure agent and the press band occurs in the vicinity of the press band and thus long paths with high thermal resistances are eliminated. It is furthermore advantageous that the heat is not only exchanged through convection between the press band and the fluid pressure agent, rather, in addition, by convection between the inventive elements located in the pressure chamber and the fluid pressure agent, and this heat is then transmitted further by means of thermal conduction between the elements and the press band. Thus a considerably larger quantity of heat can be transmitted than was hitherto possible by the turbulent formed circulation of the fluid pressure agent, because the heat transfer surface of the press band limited by the size of the pressure chamber is greatly magnified by the elements in the invention.

BRIEF DESCRIPTION OF THE DRAWINGS

Preferred embodiments of the invention are shown in the drawings and are described with particularity further below. In the drawings.

DETAILED DESCRIPTION OF THE PREFERRED EMBODIMENTS

Figure 1:
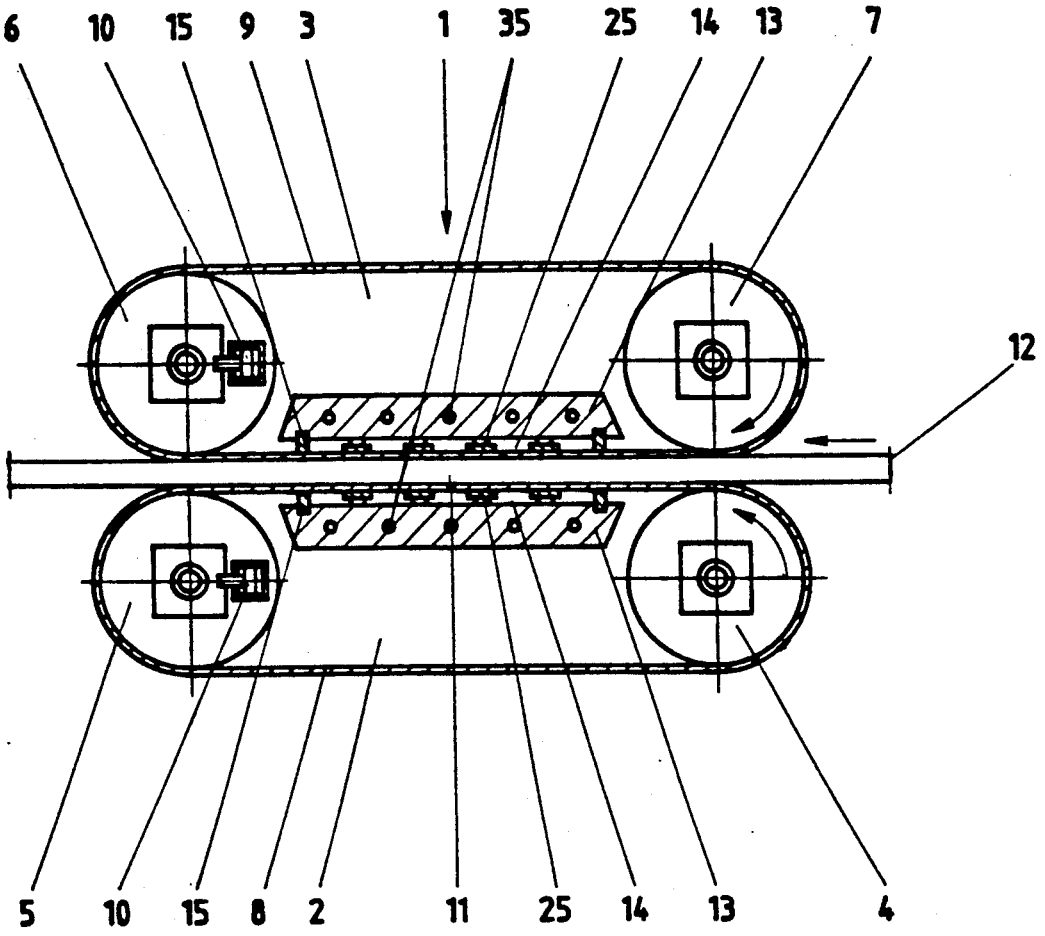
FIG. 1 shows a schematic side cross-sectional view of the working zone of a double band press according to the invention.

A continuously operating double band press 1 shown in FIG. 1 comprises a lower press band unit 2 and an upper press unit 3 which are superimposed. The press band units 2, 3 are composed of, respectively, two reversing drums 4, 5 or 6, 7 and an endless press band 8, 9. The press band usually formed of a high strength steel band is wound around the reversing drums 4, 5 or 6, 7 and is stretched by means of hydraulic cylinders 10.

The four reversing drums 4, 5, 6, 7 are rotatably supported in a press stand not shown in the drawing for reasons of clarity. At least one reversing drum of each press band unit 2, 3 is driven by a motor, so that the two press bands 8, 9 move with the same speed in directions shown by the arrows in the reversing drums 4, 7. The reaction zone 11 lies between the bottom band segment of the upper press band 9 and the upper band segment of the lower press band 8, in which the product web to be pressed 12, advancing in the drawing from the right hand side to the left hand side, is extruded or pressed under the influence of area pressure and heat and/or cooling during the passage through the double band press 1.

The product web to be pressed 12 can for instance consist of tissues, layered materials, fiber binder mixtures, thermoplast webs impregnated with synthetic resin or the like. In the discussed embodiment we are dealing, in the pressed product web 12, with individual superimposed fiberglass tissue webs so as to form layered formations, which are impregnated with epoxy resins and have copper foil or sheet webs resting upon the surfaces of the layered formation, which are extruded in a double band press to form a copper coated laminate web. Such a copper coated laminate web serves as initial material for the fabrication of printed circuit boards.

Pressure plates 13 are arranged in the press band of the double band press 1 for producing the area pressure acting upon the product webs 12 to be molded or pressed in the reaction zone 11, from which plates the pressure is applied hydraulically to the inner sides of the press bands 8 and 9 and is then transmitted from these onto the product web 12. For transmitting pressure, a pressurized fluid pressure agent is placed in the space between the pressure plate 13 and the inner side of the press band 8, 9. This space, the so-called pressure chamber, is bounded by a floating seals 15 resting against the inner side of the press band 8, 9, closed in itself and arranged in the pressure plate 13, along which seal the press band 8, 9 slides. Synthetic oil is preferred as a pressure agent. However, a gas for instance compressed air, can be used equally well. Inlet apertures 16 are provided in the pressure plate 13 for supplying the pressure agent into the pressure chamber 14; these can be seen in FIG. 3.

Figure 4:
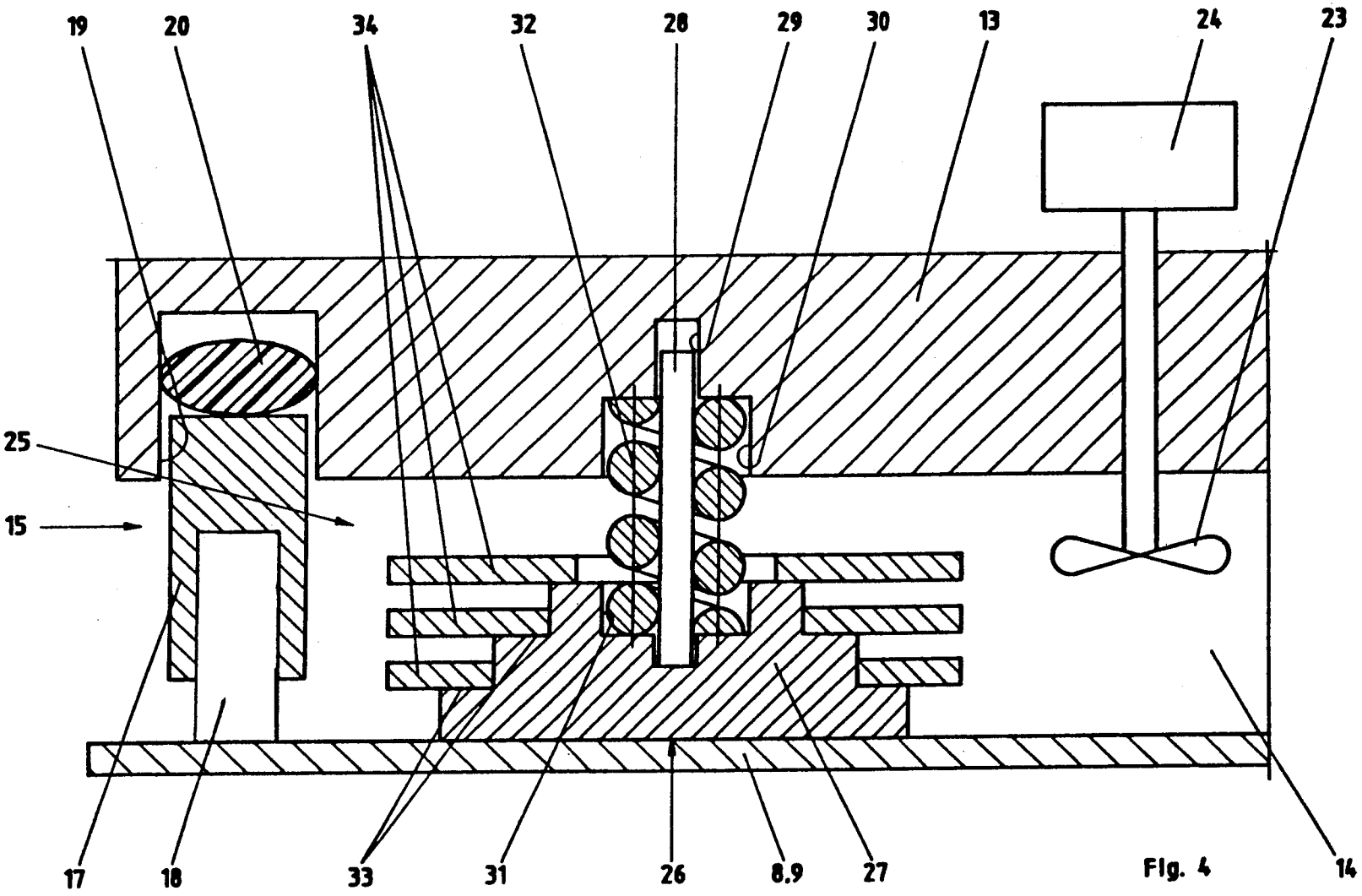
FIG. 4 shows a sectional view along the line A—A in FIG. 3.

The floating seal 15 consists of a U-shaped retaining strip 17 in which the sealing member 18 proper is fastened as is shown in detail in FIG. 4. The U-shaped retaining strip 17 is arranged in a groove 19 of the pressure plate 13 and is acted upon by a pressure agent from the bottom of the groove, so that the sealing member 18 is pressed with one face against the moving press band 8, 9, and in this way seals the pressure chamber 14 against the atmosphere. An O-ring 20 rests in the groove 19 at the U-shaped retaining strip 17 which again seals the groove 19 against the atmosphere.

Figure 2:
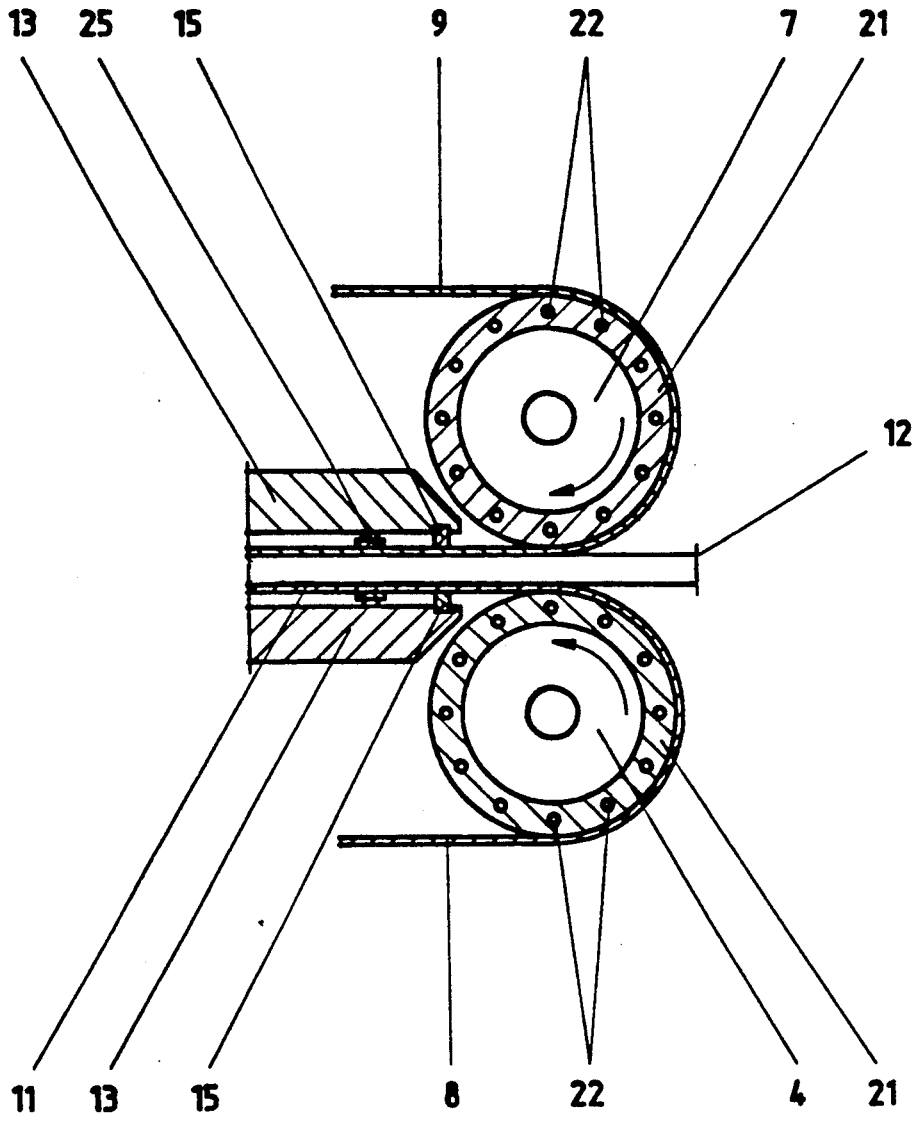
FIG. 2 shows a cross-sectional view of the inlet area of the double band press according to the invention.

The reversing drums 4, 7 on the inlet side can be made to be heatable so as to be able to heat the press bands 8, 9. As can be seen in detail in FIG. 2, bores 22 are placed for this purpose in the jacket 21 of the cylindrically-shaped reversing drums 4, 7 through which flows a heated thermal carrier agent. The heat flows from the reversing drums 4, 7 on the inlet side then into the press bands 8, 9 which convey the received quantity of heat into the reaction zone 11 and there yield it to the commodity web to be molded. Because of the limited thermal capacity of the press bands 8, 9, the quantity of heat thus transported into the reaction zone is in many cases insufficient for curing or hardening the product web 12 to be molded.

By way of a supplement or alternately for heating the reversing drums 4, 7, heated fluid pressure agent in the pressure chamber 14 can give up additional heat to the press bands 8, 9 and from there this heat can be transferred to the product web 12 to be molded in the reaction zone 11. It is also alternately possible to cool the press bands 8, 9 and with them the commodity web 12 by removal of heat to the cooled pressure agent in the pressure chambers. This heat transfer between the fluid pressure agent in the pressure chamber 14 and the pressure band 8, 9 occurs by convection. In order to improve the convection heat transfer, the fluid pressure agent is imparted a turbulent forced motion. If we are dealing with a liquid pressure agent then pumps, not shown in the drawing, can be used for producing the forced motion. If we are dealing with a gaseous pressure agent, then fans or ventilators 23 diagrammatically shown in FIG. 4 can be arranged in the pressure chamber 14, which fans are driven by motors 24, so that the fluid pressure agent located in the pressure chamber 14 is imparted a turbulent forced motion.

Heating or cooling of the pressure agent itself can be performed by a heatable- or coolable pressure plate 13. As is shown in FIG. 1, bores 35 are arranged for this purpose in the pressure plate 13. A fluid thermal carrier agent can flow through these bores 35, which yields heat to the pressure plate 13 or receives heat from same. Because of the convective heat transfer of the fluid pressure agent in turbulent forced motion in the pressure chamber 14, the pressure agent then receives heat from the heated pressure plate 13 or yields heat to the cooled pressure plate 13.

Figure 3:
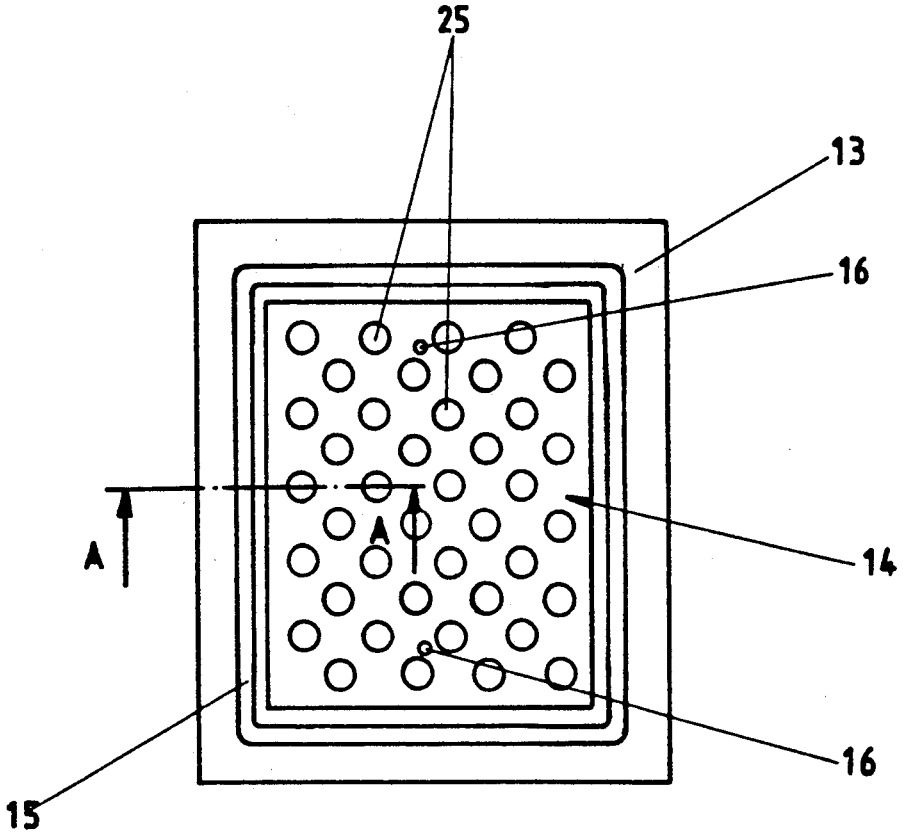
FIG. 3 shows a plan view of the pressure plate viewed from the rear side of the press band.

Alternately, or in addition, the heating or cooling of the pressure agent can also occur in a heat exchanger outside of the double band press and the pressure agent can then be introduced into or removed from the pressure chamber 14 in cyclic motion through inlet aperture 16 shown in FIG. 3.

In many applications, however, the heat quantity which can be transmitted in the described way by convection is insufficient. For additional improvement heat conducting elements 25 are arranged according to the invention, in the pressure chamber 14, as is shown in FIGS. 3 and 4. These elements 25 have a body 27 with a circular round base surface 26, which is elastically pressed against the inner side of the press band 8, 9. The heated fluid pressure agent flowing in a turbulent motion in the pressure chamber 14 yields additional heat to the surface of the body 27 of the element 25. The heat absorbed by the element 25 is absorbed in the body 27 of the element 25, which consists of a material having a good thermal conductivity, and is transferred through its base surface 26 to the press band 8, 9 which slides along the surface 26. If the pressure agent in the pressure chamber 14 is cooled, then the heat flow occurs in reverse. As can be seen in FIG. 3, the elements 25 are in order to permit as uniform as possible heat transmission to the entire press band 8, 9.

The detail design of element 25 is seen in FIG. 4. It has a body 27 with a step-shaped rotationally symmetrical cross-section. A depression 31 into whose center a vertical pin 28 is inserted is located in the center of the body 27 on its side facing the pressure plate 13. The pin 28 on its part engages into a corresponding groove 29 in the pressure plate 13. The groove 29 in the pressure plate 13 has a recess 30 on the side facing the press band 8, 9. A compression spring 32 is inserted with one end into the depression 31 and abuts with the other end against the recess 30. Due to the spring pressure of the compression spring 32, the element 25 rests elastically with the base surface 26 against the inner side of the press band 8, 9 and is mobile in vertical direction for compensation of thickness variations in the product web 12 to be pressed or molded, wherein the element 25 is guided by the pin 28.

Stepped shoulders 33 of the body 27 support surface enlargements 34. Each surface enlargement 34 has the shape of a disk, which projects from the body 27 of the element 25 and protrudes into the surrounding pressure agent. The surface enlargement 34 consist of a material having good thermal conductivity, for instance of copper or bronze and are connected with the body 27 so that a good thermal contact is assured. This connection can for instance occur by welding or soldering, for instance by means of a brazed or hard soldered connection. The solder is also selected from a material having good thermal conductivity, so that no undesirable thermal resistance is generated between the surface enlargements 34 and the body 27. Silver alloys or alloys from copper and tin are for instance suitable as a solder.

The projecting individual portions of the surface enlargements 34 protrude into the pressure agent, so that their entire surfaces, which are considerably larger than those of the body 27 itself are available for convection heat exchange between the pressure agent in the pressure chamber 14 and the element 25. Another improvement of the heat transfer can be achieved by providing the individual portions of the surface enlargements 34 themselves with ribs, protrusions, depressions or other unevenness.

In the embodiment example described, the element 25 has a body 27 with surface enlargements 34 fastened thereon. This is preferable from a fabrication technology viewpoint, however, the surface enlargements 34 and the body 27 of the element 25 can also form one single piece. In certain circumstances it can even be sufficient, to provide only the body 27 without surface enlargements 34 at the element 25, if the then convection exchanged heat between the pressure agent in turbulent forced motion in the pressure chamber and the body 27 is already sufficient.

Figure 5:
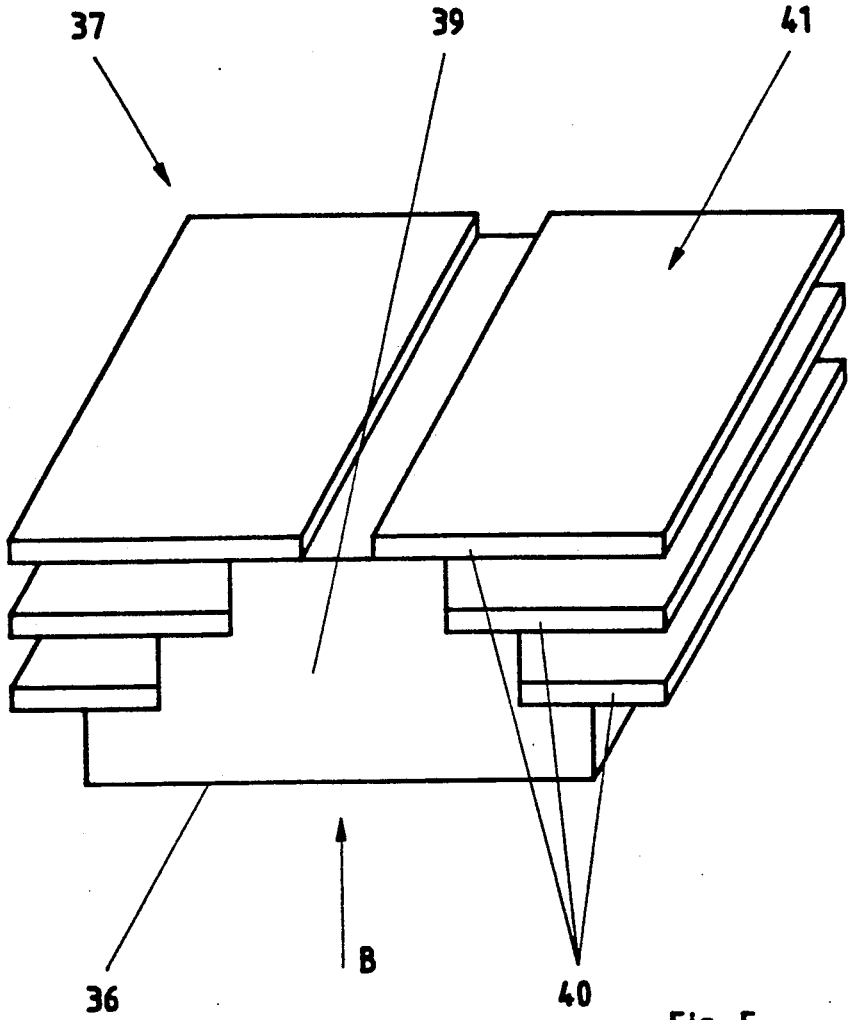
FIG. 5 shows a perspective view of another embodiment of heat conducting element of the invention.
Figure 6:
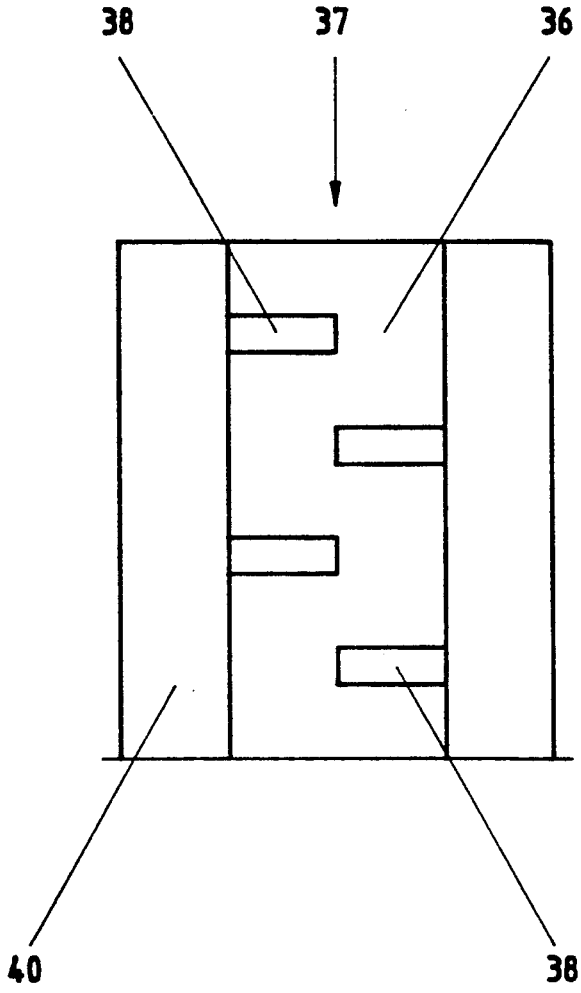
FIG. 6 shows a plan view in direction of arrow B in FIG. 5.

According to the described embodiment, the elements 25 have a body 27 with circular base surface 26. They can, however, have a body of any other random shape. Elements 37 with rectangularly shaped base surface 36 have been shown to be particularly expedient such as they be seen in FIGS. 5 and 6. The body 39 of the element 37, which is also elastically pressed with its base surface 36 against the inner side of the press bands 8, 9, has a bar-shaped, elongated form with a step-shaped cross-section. At the step-shaped shoulders of the body 39, there are again arranged elongated, rectangularly-shaped members 40 each forming a surface enlargement 41. The element 37 can be designed in such a way, that they extend across the entire width of the pressure chamber 14. In order, in spite of this, to assure a certain flexibility across the width of the pressure chamber (14), the body 39 of the element 37 has alternately incisions 38 on both sides, as they can be seen in FIG. 6 in plan viewed from the press band rear side on the element 37, so that the elements 37 can elastically adapt to the thickness variations in the commodity web 12 to be molded and the therefrom resulting vertical movements of the press band 8, 9.

It is evident that the individual surface enlargements (34, 41) at the bodies 27, 39 of the elements 25, 37 cannot only have the disk-shaped form described in the above embodiment examples, rather other shapes are also conceivable, for instance brush-shaped attachments. Of importance is that the surface enlargements protruding into the fluid pressure agent have a good thermal conduction contact with the bodies 27, 39 of the elements 25, 37.

I claim:

1. A heat conducting element for use in a continuously operating double band press including two endless press bands each wound on two reversing drums rotatably supported on a rigid press stand, and said press band having adjacent inner sides subjected to a pressure produced by a pressurized fluid in two respective pressure chambers bounded in a vertical direction by two respective pressure plates and the inner sides of the press bands and bounded in a horizontal direction by respective spaced floating seals, said heat conducting element comprising:

a body formed of a heat conductive material and designed for placement in one of said pressure chambers for transmitting heat between an inner side of said press band and the pressurized fluid, said body having a step-shaped cross-section defining a plurality of shoulders and a plurality of surface enlargement members formed of heat conductive material, and each surface enlargement member respectively supported on one of said plurality of shoulders so as to project therefrom substantially parallel to said pressure plate and into said pressurized fluid;

means for providing thermoconductive contact between said body and said surface enlargement members; and means for elastically pressing said body against the inner side of the press band.

2. A heat conducting element according to claim 1, wherein said surface enlargement members are provided with one of ribs, projections, depressions serving as surface enlarging means.

3. A heat conducting element according to claim 1, wherein said surface enlargement members are connected to said body by one of a silver alloy, and a copper and tin alloy.

4. A heat conducting element according to claim 1, wherein said body is formed of one of copper and bronze.

5. A heat conducting element according to claim 1, wherein said surface enlargement members consist of one of copper and bronze.

6. A heat conducting element according to claim 1, wherein said surface enlargement members have a shape of a disk.

7. A heat conducting element according to claim 1, wherein said body has a shape of a body of revolution with a circular base surface.

8. A heat conducting element according to claim 1, wherein said body has a bar-shaped form with a rectangular base surface.

9. A heat conducting element according to claim 1, wherein said heat conducting element has a width substantially equal to a width of the pressure chamber.

10. A heat conducting element according to claim 1, wherein said body has an incision on opposite longitudinal sides thereof for attaining flexibility in its longitudinal direction.

11. A heat conducting element according to claim 1, wherein said means for elastically pressing comprises a compression spring.

12. A head conducting element according to claim 11, wherein said body has a depression on a surface thereof facing the pressure plate, said heat conducting element further comprising a pin for supporting said spring and for guiding said body toward and away from said pressure plate, and said pin having first and second ends, said first end located in said depression and said second end engaging a groove provided in said pressure plate.

13. A heating conducting element according to claim 12, wherein said pressure plate has a shoulder surrounding said groove, said compression spring has first and second ends, said first end of said spring located in said depression and said second end of said spring supported on said shoulder.

14. A double band press for fabrication of a product, said press comprising:

a rigid press stand;

two pairs of horizontally-spaced reversing drums rotatably supported on said rigid press stand; two endless press bands each guided about a pair of said drums, and each having an inner side facing one another for guiding and pressing said product;

two pressure plates supported in the press stand for applying pressure to said inner sides of said two endless press bands, respectively, said two pressure plates and said inner sides of said two endless press bands partially defining two respective pressure chambers each filled with a pressurized fluid for applying fluid pressure to said inner sides;

two pairs of spaced floating seals for bounding, respectively, said two pressure chambers in a horizontal direction; and at least one heat conducting element in each of said two pressure chambers which comprises:

a body formed of a heat conductive material for transmitting heat between the inner side of said respective press band and the pressurized fluid;

said body having a flat surface adjacent said press band and a plurality of surface enlarging heat transfer fins formed of a heat conductive material extending circumferentially from said body into the pressurized fluid for providing heat transfer between said pressurized fluid and said body; and means for elastically pressing said body with its flat side against the inner side of the respective press band for facilitating heat transfer between said body and said product through said press band while firmly backing up said press band.

15. A double band press according to claim 14, further comprising means for alternatively heating and cooling said pressurized fluid.

16. A double band press according to claim 15, wherein said alternatively heating and cooling means includes bores formed in said pressure plates.

17. A double band press according to claim 14, further comprising means for producing a turbulent forced motion of the pressurized fluid in the pressure chamber.

18. A double band press according to claim 17, wherein said turbulent forced motion producing means comprises a fan.

19. A double band press according to claim 17, wherein said turbulent forced motion producing means comprises a pump.

* * * * *